US007857603B2

(12) United States Patent
Zamudio

(10) Patent No.: US 7,857,603 B2
(45) Date of Patent: Dec. 28, 2010

(54) PIEZOELECTRIC DRIVE FOR SCROLL COMPRESSOR

(75) Inventor: Carlos A. Zamudio, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 782 days.

(21) Appl. No.: 11/782,141

(22) Filed: Jul. 24, 2007

(65) Prior Publication Data

US 2009/0028728 A1 Jan. 29, 2009

(51) Int. Cl.
*F04B 35/04* (2006.01)

(52) U.S. Cl. ..... 417/410.5; 417/410.3

(58) Field of Classification Search ..... 417/410.3, 417/410.5

See application file for complete search history.

(56) References Cited

U.S. PATENT DOCUMENTS

| | | | | |
|---|---|---|---|---|
| 2,703,370 | A * | 3/1955 | Johan | 310/82 |
| 4,950,135 | A * | 8/1990 | Tojo et al. | 417/410.5 |
| 6,036,828 | A | 3/2000 | Beers | |
| 6,368,065 | B1 * | 4/2002 | Hugenroth et al. | 417/53 |
| 6,710,483 | B2 * | 3/2004 | Ota et al. | 310/82 |

* cited by examiner

*Primary Examiner*—Charles G Freay
(74) *Attorney, Agent, or Firm*—Carlson, Gaskey & Olds

(57) ABSTRACT

Compressors are defined by two relatively moving members, which have a relative orbital movement between the two. Piezoelectric elements are associated with each of the two moving members to cause the moving members to result in the orbital movement.

17 Claims, 1 Drawing Sheet

PIEZOELECTRIC DRIVE FOR SCROLL COMPRESSOR

BACKGROUND OF THE INVENTION

This application relates to a compressor, wherein piezoelectric elements are actuated to control orbiting movement of the members in the compressor.

Scroll compressors are becoming widely utilized in refrigerant compression applications. In a scroll compressor, a first scroll member has a base and a generally spiral wrap extending from its base. A second scroll member has a base and a generally spiral wrap extending from its base. The two wraps interfit to define compression chambers. In standard scroll compressors, an electric motor drives a shaft to in turn cause one of the two scroll members to orbit relative to the other. As the two scroll members orbit, the compression chambers between the wraps decrease in size, and an entrapped refrigerant is compressed.

Another type of compressor that is utilized in refrigerant compression applications is a rotary compressor. In a rotary compressor, a housing surrounds a rotor, and a vane contacts the rotor, and moves inwardly and outwardly of the housing. The rotor and the housing are caused to orbit relative to each other, and an entrapped refrigerant is compressed during this orbiting movement.

There has been some effort proposed to provide alternative drives for at least scroll compressors. Thus, in one prior patent, a piezoelectric drive is proposed, which moves a scroll member through a complex back and forth movement to achieve the compression. While piezoelectric drive elements would be beneficial in reducing the size of the compressor, and also reducing the number of drive components, the proposed drive is complex, and impractical.

SUMMARY OF THE INVENTION

In the disclosed embodiment of this invention, compressor members are provided with opposed piezoelectric elements. A control selectively actuates the piezoelectric elements to expand and contract.

In a scroll compressor embodiment, the expansion and contraction, the scroll members are caused to move in a linear fashion. In a disclosed embodiment, there are opposed piezoelectric elements associated with each of an orbiting and a non-orbiting scroll. The two members are caused to move in controlled cycles, such that the overall relative movement is an orbiting movement to entrap and compress a refrigerant.

This embodiment provides a very simple method of driving the scroll members, and further provides a very powerful technique for achieving a orbiting cycle which is exactly as desired. By properly controlling the movement of the two scroll members, any orbiting movement can be achieved. The orbit can be elliptical, square, etc. Further, by simply changing the frequency of the cycles, a designer is able to easily increase or decrease capacity of the scroll compressor.

In disclosed embodiments, each of the two scroll members are driven along a sinusoidal wave cycle.

In a second disclosed embodiment, the piezoelectric elements drive a rotor and a housing for a rotary compressor. Again, by controlling the movement of the two elements, any orbiting movement can be achieved.

These and other features of the present invention can be best understood from the following specification and drawings, the following of which is a brief description.

DETAILED DESCRIPTION OF THE PREFERRED EMBODIMENT

Figure 1:
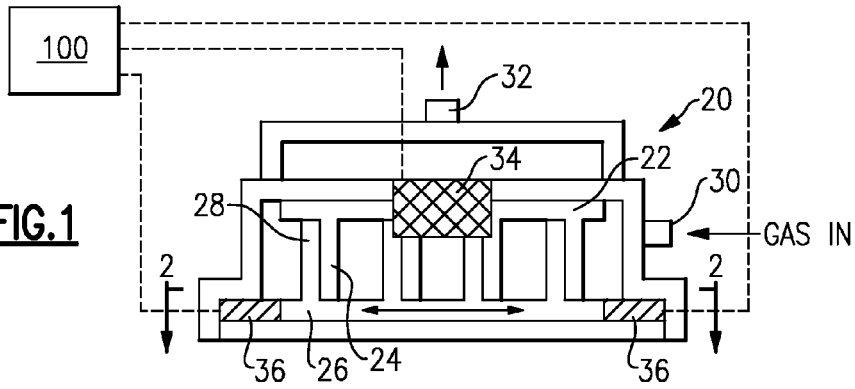
FIG. 1 is a view of a scroll compressor incorporating the inventive drive.

A scroll compressor 20 is illustrated in FIG. 1. As known, a first scroll 22 includes a base and a generally spiral wrap 24 extending from that base. A second scroll 26 has a base and a spiral wrap 28 extending from its base. The two wraps interfit to define compression chambers, as known. A casing surrounds the first and the second scrolls and includes a suction tube 30 and a discharge port 32. A refrigerant to be compressed enters through the suction tube 30, and flows into the compression chambers between the wraps 24 and 28. The refrigerant is compressed as the two wraps orbit relative to each other, and deliver outwardly through the discharge port 32.

As shown in FIG. 1, piezoelectric elements 34 are associated with the base of the first scroll 22, and piezoelectric elements 36 are associated with the second scroll member 26.

Figure 2:
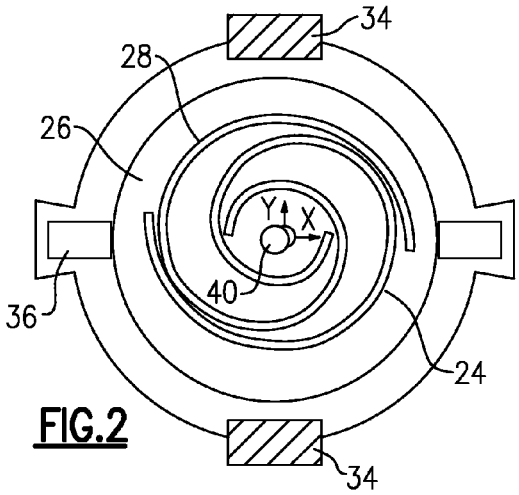
FIG. 2 is a cross-sectional view along line 2-2 of FIG. 1.

As shown in FIG. 2, the piezoelectric elements 36 are mounted at opposed sides of the base of the second scroll member 26. The piezoelectric elements 34 are mounted in a similar fashion on scroll member 22. Some guiding structure may be included to ensure the movement of the second scroll member 26 is generally linear, and along an X axis, and that the movement of the first scroll member 22 is also linear, and along a Y axis as shown in FIG. 2. The discharge port 40 receives the compressed refrigerant, and delivers it downstream to the discharge port 32.

Figure 3:
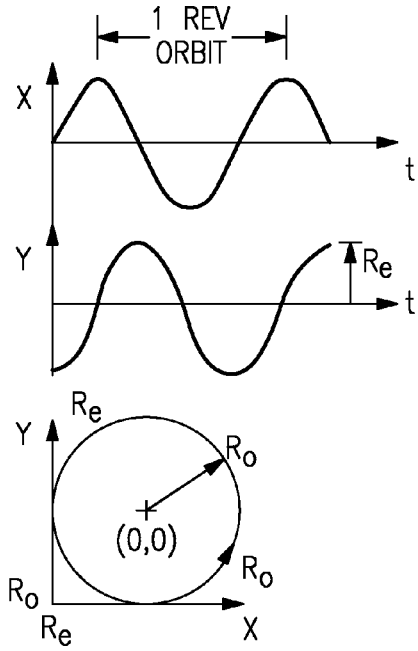
FIG. 3 shows drive cycles for the inventive scroll compressor.

As shown in FIG. 3, the second scroll member 26 may be driven along a sinusoidal cycle and in the X direction. Similarly, the first scroll member 22 can be driven along the Y axis in a sinusoidal cycle. As shown, the two cycles can be offset by 90°. The resultant overall relative movement can be as shown in the bottom chart of FIG. 3, and thus the resultant movement can be an orbital movement.

A designer of a control 100 for the scroll compressor 20 would recognize that the inventive drive arrangement provides a powerful tool for achieving many beneficial characteristics. As can example, by simply changing the cycle frequency of the actuation of the piezoelectric elements, varying capacity can be easily achieved. In the past, varying capacity has typically required very complex structure. The present invention provides varying capacity with the simple piezoelectric drive elements.

In addition, an exactly tailored relative orbital movement can be easily achieved by properly controlling the timing and magnitude of the movement of the scroll member 22 and 26.

Figure 4:
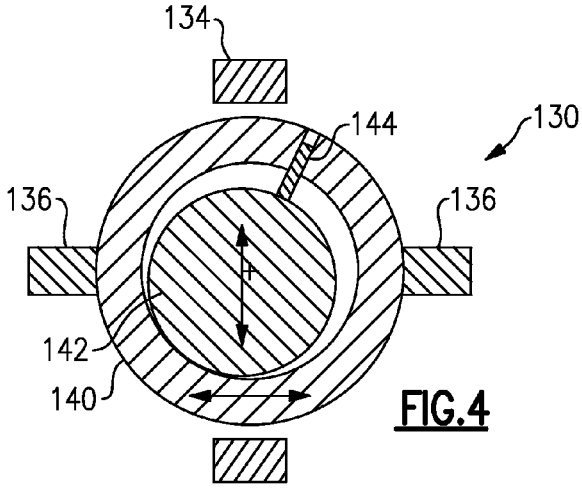
FIG. 4 shows a second embodiment.

FIG. 4 shows another embodiment 130, which is a rotary compressor. In this rotary compressor, a housing 140 surrounds a rotor 142. The rotor 142 includes a driveshaft (not shown), which is driven by piezoelectric elements 134. A second set of piezoelectric elements 136 drive the housing 140. In a fashion similar to that mentioned above with regard to the scroll compressor embodiment, the orbital movement of the elements 140 and 142 can be controlled to achieve any desired cycle. As known, a vane 144 contacts the outer periphery of the rotor 142, to define compression chambers that decrease in volume as the rotor 142 orbits. As shown in this figure, the rotor 142 can actually be caused to move generally linearly upwardly and downwardly in this figure while the housing moves left to right in this figure. The combination of the two movements can achieve an orbital movement.

A worker of ordinary skill in the art would recognize the various modifications and movements which can be achieved with the present invention.

While a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a first moving member, and a second moving member, with compression chambers defined between said first and second moving members;

a casing surrounding the first and second moving members; and a piezoelectric element mounted between the casing and each of said first and second moving members to move the moving members; and a control to cause the two moving members to have a relative orbital movement between the two moving members.

2. The compressor as set forth in claim 1, wherein said first and second moving members are first and second scroll members each having a base and a generally spiral wrap extending from its base.

3. The compressor as set forth in claim 1, wherein opposed piezoelectric elements are mounted on a base of said at least one of said first and second scroll members.

4. The compressor as set forth in claim 3, wherein opposed piezoelectric elements are disposed on the bases of both said first and second scroll member in opposed positions.

5. The compressor as set forth in claim 4, wherein said piezoelectric elements associated with said first scroll member are offset by 90° with said piezoelectric elements associated with said second scroll member.

6. The compressor as set forth in claim 2, wherein said first and second scroll members are driven by the associated piezoelectric elements through sinusoidal cycles.

7. The compressor as set forth in claim 6, wherein said sinusoidal cycles of the piezoelectric elements associated with said first and second scroll members are offset by 90°.

8. The compressor as set forth in claim 2, wherein an operational cycle of said piezoelectric element is controlled to change the capacity of said scroll compressor.

9. The compressor as set forth in claim 1, wherein said first and second moving members are a rotary compressor housing and rotor.

10. The compressor as set forth in claim 9, wherein said rotor and said housing each having generally linear movement caused by respective sets of piezoelectric elements.

11. A scroll compressor comprising:

a first scroll member having a base and a generally spiral wrap extending from its base;

a second scroll member having a base and a generally spiral wrap extending from its base;

a casing surrounding the first and second scroll members;

piezoelectric elements mounted between the casing and the first and second scroll members and capable of expanding and contracting to move both said first and second scroll members in a linear direction, to cause the wraps of said first and second scroll members to have an orbital relative movement; and said first and second scroll members are driven by the associated piezoelectric elements through sinusoidal cycles.

12. The scroll compressor as set forth in claim 11, wherein opposed piezoelectric elements are mounted on said base of each of said first and second scroll members.

13. The scroll compressor as set forth in claim 11, wherein said piezoelectric element associated with said first scroll member are offset by 90° with said piezoelectric elements associated with said second scroll member.

14. The scroll compressor as set forth in claim 11, wherein said sinusoidal cycles of the piezoelectric elements associated with said first and second scroll members are offset by 90°.

15. The scroll compressor as set forth in claim 11, wherein an operational cycle of said piezoelectric element is controlled to change the capacity of said scroll compressor.

16. A rotary compressor comprising:

a housing having an internal bore;

a moving member mounted within said internal bore;

a vane mounted within said housing, and in contact with an outer periphery of said moving member;

a casing surrounding said housing; and a first piezoelectric element mounted between said casing and said housing for moving said housing in a first linear direction, and a second piezoelectric element mounted between said casing and said moving member for moving said moving member in a second distinct linear direction, such that in combination the housing and the moving members have a generally orbital movement to define compression chambers, and decrease the size of those compression chambers in combination with said vane.

17. The rotary compressor as set forth in claim 16, wherein there are a pair of piezoelectric elements associated with each of said housing and said moving member, and said pair of piezoelectric elements being mounted on opposed sides of each of said housing and said moving member.

* * * * *